United States Patent [19]

Perbix

[11] Patent Number: 4,726,446

[45] Date of Patent: Feb. 23, 1988

[54] PROTECTION COVER FOR LADDER

[76] Inventor: Thomas H. Perbix, 2238 Florida Ave. S., St. Louis Park, Minn. 55426

[21] Appl. No.: 26,298

[22] Filed: Mar. 16, 1987

[51] Int. Cl.[4] ..... E06C 7/48

[52] U.S. Cl. ..... 182/46; 182/107; 182/129

[58] Field of Search ..... 182/107, 108, 129, 46

[56] References Cited

U.S. PATENT DOCUMENTS

| | | | |
|---|---|---|---|
| 1,600,103 | 9/1926 | Evans . | |
| 2,138,171 | 11/1938 | Johnson . | |
| 2,200,902 | 5/1940 | Solomon . | |
| 2,904,128 | 9/1959 | Boham | 182/108 |
| 2,925,877 | 2/1960 | Wright | 182/108 |
| 3,115,212 | 12/1963 | Keatley | 182/108 |
| 3,662,856 | 5/1972 | D'Amico | 182/108 |
| 3,993,163 | 11/1976 | Barrett | 182/108 |
| 4,356,854 | 11/1982 | McGee | 182/129 |
| 4,469,193 | 9/1984 | Rumsey | 182/107 |

*Primary Examiner*—Reinaldo P. Machado
*Attorney, Agent, or Firm*—Burd, Bartz & Gutenkauf

[57] ABSTRACT

A protection cover for a ladder has front and rear side walls located over and extended between the upper end of the rails of a ladder. A releasable strap holds the cover on the ladder. A plurality of pads of resilient non-electrical conductive material are secured to the back side wall to protect the support surface for the ladder from the support. A pocket is secured to the front side wall to hold tools and like objects.

21 Claims, 3 Drawing Figures

PROTECTION COVER FOR LADDER

FIELD OF INVENTION

This invention relates to an apparatus for covering the top end of a ladder to reduce ladder slip and electrical shock.

BACKGROUND OF INVENTION

Conventional extension ladders have a pair of side rails connected together by a plurality of rungs. In use, the bottom of the ladder is positioned on a horizontal surface adjacent a vertical surface or wall and the top of the ladder is angled toward the wall until the tops of the side rails engage the wall. Adjustment of the position and length of the ladder may cause scraping and scratching of the wall. The tops of the side rails can slip when a person is on the ladder. This may result in personal injury and/or wall damage. Also, an electrical shock can be conducted through a metal or wood ladder to a person on or near the ladder.

In the past, various structures have been used to fit over the ends of a ladder to protect the wall supporting the upper ends of the ladder. Ladder protector devices are disclosed by Evans in U.S. Pat. No. 1,600,103 and Johnson in U.S. Pat. No. 2,138,171. These devices have a rubber body with a cavity that fit over the top end of each side rail of a ladder to prevent ladder slippage. The rubber body also prevents marring of painted surfaces or other surfaces and insulates from electrical shock.

SUMMARY OF INVENTION

The invention is directed to a protection cover for use with a ladder to minimize scratching, marring, and damage to an upright support, such as a wall, and electrically insulate the ladder from the support to minimize the electrical shock to persons on or near the ladder. The cover fits over and extends between the upper ends of the side rails of a ladder. A releasable connector is used to hold the cover on the ladder. The cover is provided with resilient electrical non-conductive pads which engage the support when the ladder is in an upright position. The pads minimize the movement of the upper end of the ladder relative to the support has substantial frictional characteristics and are made of material that electrically insulate the ladder from the support.

In one form of the protective cover of the invention, the cover has front and back side walls joined to end walls providing a chamber having an open bottom for accommodating the upper ends of the side rails of the ladder. The side rails of the ladder are located adjacent the end walls of the cover. The resilient electrical non-conductive pads are secured to the back side wall of the cover and are in vertical alignment with the side rails of the ladder. The cover is provided with a pair of pads that extend upwardly relative to the back side wall of the cover and over the top wall of the cover. The connector means used to retain the cover on the ladder comprises a strap means attached to one side wall and extendable about a rung of the ladder, such as the top rung. The connector means includes releasable fastening means that releasably join the strap means to the other side wall of the cover. The fastening means comprise hook and loop members that are releasably cooperating with each other that are manually separable so that the cover can be readily removed from the ladder.

The cover is provided with a pocket structure used to facilitate the storage of tools and the like. The pocket structure comprises a sheet member and end members attached to the front side wall of the cover. The top of the sheet member is separated from the front side wall providing an open top pocket for accommodating the tools and the like.

These objects and advantages of the protective cover of the invention as well as additional advantages thereof are embodied in the preferred embodiment of the protection cover as shown in the drawings and described in the following description.

DESCRIPTION OF PREFERRED EMBODIMENT

Figure 1:
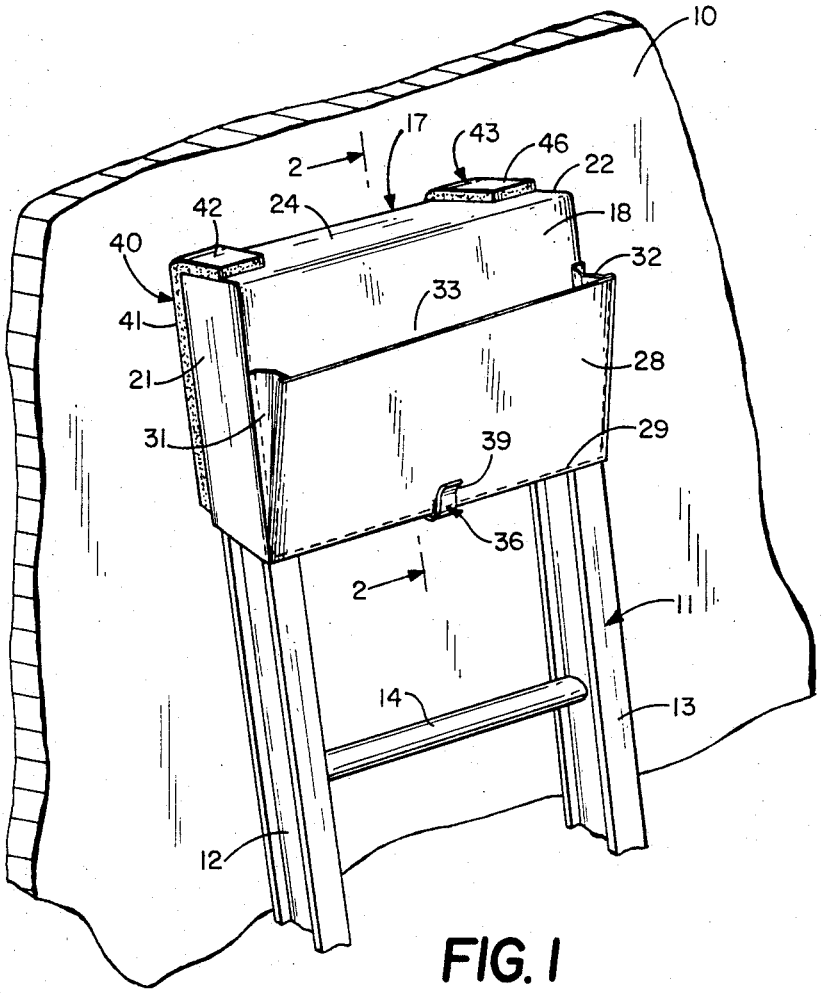
FIG. 1 is a perspective diagrammatic view of a ladder equipped with the protection cover of the invention.

A conventional rung ladder 11 is propped against an upright structure or wall 10. The ladder 11 is constructed of structural metal, such as aluminum, and has upright side rails 12 and 13. A plurality of horizontal rungs 14 including a top rung 16 extend between and secured to side rails 12 and 13. Ladder 11 is a conventional extension ladder that can vary in length. Also, the ladder can be made of wood or other structural materials. The backsides of the upper ends of side rails 12 and 13 normally rest on upright wall 10. Movement of ladder 11 relative to wall 10 can cause marring and scraping of the outer surface of wall 10. Ladder 11 being of metal or the like electrical conductive material is an excellent conductor of electricity and thereby can result in electrical shock to the user when it comes close to or in contact with electrical power sources.

Figure 2:
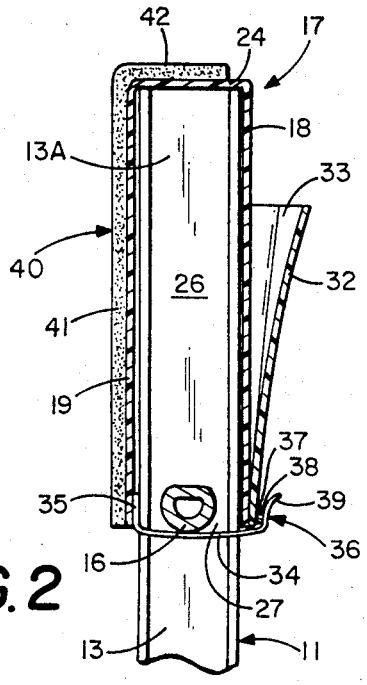
FIG. 2 is an enlarged sectional view taken along the line 2—2 of FIG. 1.
Figure 3:
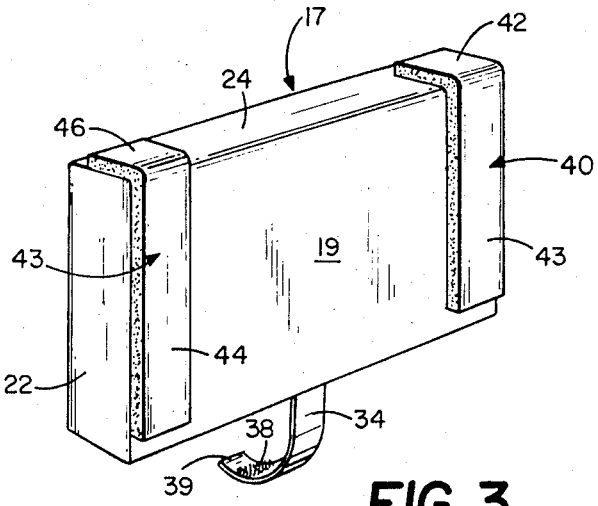
FIG. 3 is a perspective view of the rear of the protection cover.

A protection cover indicated generally at 17 is located over and extends between the upper ends of the ladder side rails 12 and 13 to minimize the scraping and scratching of wall 10 and minimize electrical shock to persons on the ladder. Cover 17 is an inverted box-shape structure made of viinyl plastic sheet material canvas, tarp material and the like. Cover 17 has generally rectangular front side wall 18 and a complementary back side wall 19. End walls 21 and 22 join opposite ends of the walls 18 and 19. A top wall 24 closing the top of cover is secured along with the perimeter thereof to side walls 18 and 19 and end walls 20 and 22. The walls 18, 19, 21 and 22 and 24 form a chamber 26 having an open bottom 27. The upper ends of the side rails, such as end 13A of side rail 13 as shown in FIG. 2, are located in chamber 26 adjacent end walls 21 and 22. The upper ends of the side walls retain the generally rectangular or box-shape configuration of cover 17.

As shown in FIGS. 1 and 2, a generally rectangular sheet member 28 is located in front of side front wall 18. The bottom of sheet member 28 is secured with a fastener or seam 29 to the bottom edge of front side wall 18. A pair of end members 31 and 32 each having generally folded rectangular shape secure the opposite sides of sheet member 28 to the front side wall 18. The sheet member 28 along with end members 31 and 32 form a open top pocket 33 for accommodating objects such as tools, supplies and the like, at the top of ladder 11.

Releasable fastening means comprising a strap 34 is used to retain cover 17 on the upper ends of side rails 12 and 13. Strap 34 has an end 35 that is secured to back side wall 19. The opposite end of strap 34 has a releasable fastener 36 attached to the bottom of sheet member 28. Releasable fastener comprises loop members 37 and hook members 38. The loop and hook members 37 and 38 comprises a conventional Velcro fastener. Strap 34 has a end tab 39 extended outwardly from member 38 to facilitate the release of fastener 36. Tab 39 has a length adapted to be gripped with a hand of a person to pull the tab 39 and strap from loop member 37.

Cover 17 has a pair of cushions or pad members 40 and 43 vertically aligned with side rails 12 and 13 of ladder 11. Pad member 40 has an elongated upright back pad 41 and a top pad 42 secured with adhesive and the like to back side wall 19 and top wall 24 adjacent end wall 21. Pad member 43 has an upright back pad 44 and a top pad 46 secured to back side wall 19 and top wall 24 adjacent the end wall 22. Pad members 40 and 43 are elongated linear strips of sponge rubber or foam plastic that are bonded to the opposite ends of the back side wall 19 and adjacent portions of top wall 24. Pad members 40 and 43 are resilient and compressible and have substantial friction characteristics which inhibit the movement of ladder 11 relative to wall 10. The back pads 43 and 44 are aligned with the back upright surfaces of the ladder side rails 12 and 13 so that there is direct and aligned bearing force from ladder 11 to pad members 40 and 43. Each pad member 40 and 43 has an inverted L-shape and is made of resilient non-electrical conductive material so as to provide insulation from electrical shocks to persons on or near ladder 11.

In use, cover 17 is placed over the top ends of the side rails 12 and 13 of ladder 11. Strap 34 folds under upper rung 16 of the ladder. The releasable fastener 36 is closed by moving the hook members 37 into loop members 38 thereby holding the strap under rung 16 as shown in FIG. 2. This holds cover 14 in a snug relationship over the top of side rails 12 and 13 of ladder 11. Strap 34 prevent the accidental separation and removal of cover 17 from ladder 11. A plurality of straps 34 with releasable fasteners 36 can be used to hold the cover on ladder 11. The straps can be located adjacent the insides of side rails 12 and 13.

Cover 17 aligns the resilient pad members 40 and 43 with the back sides of the ladder side rails 12 and 13. The weight of the ladder and the person on the ladder is directly transmitted through pad members 40 and 43 to wall 10. This will compress th resilient material of the pad members 40 and 43 and enhance the frictional contact between the pad members 40 and 43 and the wall 10. This reduces the tendency of the upper ends of the ladder to move relative to wall 10 thereby minimizing the marring and scraping of wall 10. The resilient material of the pad members 40 and 43 also maintain the upper ends of side rails 12 and 13 of the ladder away from wall 10 so that the ladder does not scratch, scrape or marr the surface of wall 10. The pad members 40 and 43 being of resilient electrically non-conductive material function as electrical insulators in the event that the upper end of the ladder is moved in proximity to a electrical power line or other electrical power source.

Cover 17 is readily removed from the upper end of ladder 11. The ladder is returned to its horizontal ground position. The person grips tab 39 and pulls fastener 36 to release the loop and hoop members 37 and 38. The cover 17 is then longitudinally removed from the upper end of the side rails 12 and 13 of ladder 11. The material of cover 11 being flexible allows the cover 17 to be flattened or rolled for convenient storage.

While there has been shown and described a preferred embodiment of the protection cover for a ladder of the invention, it is understood that changes in the size, materials, arrangement of parts, and types of fasteners and resilient pad members of the cover and type of ladder may be made by those skilled in the art without departing from the invention. The invention is defined in the following claims.

I claim:

1. In combination: a ladder having upright generally parallel side rails and rungs extended between and secured to the side rails, said side rail having upper ends adapted to rest on an upright support to retain the ladder in a generally upright position, cover means extended between and located over the upper ends of the side rails, said cover means having parallel and rectangular front and back side walls, a top wall, and end walls connected normally to the side walls providing an inverted box-shaped chamber having an open bottom, said walls being flexible sheet members joined together to form said inverted box-shaped chamber, said upper ends of the side rails being located in the chamber adjacent said end walls and opposite end portions of the front and back side walls, means holding the cover means on the side rails, and resilient electrical non-conductive means attached to the back side wall of the cover means adapted to engage the support when the ladder is in an upright position to protect the support from damage and electrically insulate the ladder from the support, said resilient electrical non-conductive means including a first resilient electrical non-conductive pad secured to one opposite end portion of the back side wall in alignment with one side rail and a second resilient electrical non-conductive pad secured to the other opposite end portion of the back side wall in alignment with the other side rail whereby the side rails of the ladder transmit direct and aligned bearing forces on the first and second pads so as to inhibit movement of the upper end of the ladder relative to the upright support.

2. The structure of claim 1 wherein: said first pad extends over the top wall and is secured thereto, said second pad extends over the top wall and is secured thereto.

3. The structure of claim 2 wherein: each pad is an elongated strip of foamed resilient material bonded to said back side wall and top wall.

4. The structure of claim 1 wherein: said means holding the cover means on the side rails comprise strap means attached to one side wall and extended about a rung, and releasable fastening means connecting the strap means to the other side wall.

5. The structure of claim 4 wherein: said fastening means comprise loop means and hook means releasably cooperating with the loop means selectively connected to said strap means and other side wall.

6. The structure of claim 1 including: means secured to the front side wall of the cover means providing a pocket having an open top.

7. The structure of claim 6 wherein; the means secured to the cover means comprises a sheet member and flexible end walls attached to the sheet member, said sheet member and end walls being secured to the front side wall of the cover means providing said pocket.

8. In combination: a ladder having upright generally parallel side rails and rungs extended between and secured to the side rails, said side rails having upper ends adapted to rest on an upright support to retain the ladder in a generally upright position, cover means extended between and located over the upper ends of the side rails, said cover means having front and back side walls located on opposite sides of the upper ends of the side rails, end walls secured to the front and back side walls located adjacent opposite outside portions of the upper ends of the side rails, and a top wall joined to the side walls and end walls providing an inverted box-shaped chamber having an open bottom accommodating the upper ends of the side rails, said side rails being located in said chamber adjacent the end walls, and opposite end portions of the front and back side walls, and resilient electrical non-conductive means attached to the opposite end portions of the back side adjacent the end walls of the cover means adapted to engage the support when the ladder is in an upright position to protect the support from damage and electrically insulate the ladder from the support, said resilient electrical non-conductive means comprising a first resilient upright pad secured to one opposite end portion of the back side wall adjacent the one end wall of the cover means and a second resilient electrically non-conductive pad secured to the other opposite end portion of the back side wall adjacent the other end wall, said pads being in alignment with the upper ends of the side rails of the ladder whereby the side rails of the ladder transmit direct and aligned bearing forces on the first and second pads so as to inhibit movement of the upper end of the ladder relative to the upright support.

9. The structure of claim 8 including: at least one strap means attached to one of the front or back side walls and extended about a rung, and releasable fastening means connected the strap means to the other side wall.

10. The structure of claim 9 wherein: said releasable fastening means comprising loop means and hook means releasably cooperating with the loop means selectively connected to said strap means and said one of the walls.

11. The structure of claim 8 including: means secured to the front side wall providing a pocket having an open top.

12. The structure of claim 11 wherein: the means secured to the front side wall comprises a sheet member having a bottom portion secured to the front side wall and end members secured to the sheet member and front side wall providing said pocket.

13. The structure of claim 8 wherein: each pad is an elongated strip of resilient material secured to said opposite end portions of the back side wall and top wall.

14. A protection cover for a ladder having upright side rails and rungs extended between and secured to the side rails, said side rails having upper ends adapted to rest on an upright support to retain the ladder in a generally upright position comprising: cover means adapted to and extended between and located over the upper ends of the side rails of the ladder, said cover means having a top wall, parallel front and back side walls, and end walls normally connected to the side walls and top wall providing an inverted box-shaped chamber having an open bottom for accommodating said upper end of the side rails of the ladder adjacent said end walls and opposite end portions of said front and back side walls, means connected to the cover means adapted to hold the cover means on the side rails of the ladder, and resilient electrical non-conductive means attached to the cover means adapted to engage the support when the ladder is in an upright position to protect the support from damage and electrically insulate the ladder form the support, said resilient electrical non-conductive means including separate pad means secured to said opposite end portions of said back side wall in alignment with said side rails of the ladder whereby the side rails of the ladder transmit direct and aligned bearing forces on the separate pad means so as to inhibit movement of the upper end of the ladder relative to the upright support.

15. The cover of claim 14 wherein: said resilient electrical non-conductive means comprises a first pad secured to the back side wall one opposite end portion thereof adjacent one end wall and a second pad spaced from the first pad secured to the other opposite end portion of the back side wall adjacent the other end wall.

16. The cover of claim 15 wherein: each pad has a portion extended over the top wall and secured thereto.

17. The cover of claim 16 wherein: each pad is an elongated strip of resilient material secured to an opposite end portion of said back side wall and top wall.

18. The cover of claim 14 wherein: said means adapted to hold the cover means on the side rails comprise strap means attached to one side wall and extendable about a rung, and releasable fastening means connecting the strap means to the other side wall.

19. The cover of claim 18 wherein: said fastening means comprise loop means and hook means releasably cooperating with the loop means selectively connected to said strap means and other side wall.

20. The cover of claim 14 including: means secured to the cover means providing a pocket having an open top.

21. The cover of claim 20 wherein: the means secured to the cover members comprises a sheet member and flexible end walls, said sheet member and end walls being secured to the cover means providing said pocket.

* * * * *